US010982476B1

(12) United States Patent
Fisher

(10) Patent No.: US 10,982,476 B1
(45) Date of Patent: Apr. 20, 2021

(54) SUPPORT ATTACHMENTS FOR A DOOR AND A DOOR FRAME

(71) Applicant: Carl M. Fisher, Chino Valley, AZ (US)

(72) Inventor: Carl M. Fisher, Chino Valley, AZ (US)

( * ) Notice: Subject to any disclaimer, the term of this patent is extended or adjusted under 35 U.S.C. 154(b) by 31 days.

(21) Appl. No.: 16/404,974

(22) Filed: May 7, 2019

(51) Int. Cl.
*E05F 7/06* (2006.01)
*E05D 13/00* (2006.01)
*E05D 15/02* (2006.01)

(52) U.S. Cl.
CPC ..... *E05D 13/006* (2013.01); *E05D 15/02* (2013.01); *E05Y 2800/407* (2013.01); *E05Y 2900/132* (2013.01)

(58) Field of Classification Search
CPC . E05D 13/006; E05D 15/02; E05Y 2800/407; E05Y 2900/132
USPC ..... 49/396, 226, 234, 235
See application file for complete search history.

(56) References Cited

U.S. PATENT DOCUMENTS 152,049 A * 6/1874 Roderick ..... 49/237
1,334,442 A 3/1920 Eanes
1,673,450 A * 6/1928 Gilpin ..... B61D 19/002 49/254
1,775,974 A 9/1930 Solms, Jr.
1,963,475 A * 6/1934 Schonitzer ..... E05F 5/025 49/396
2,472,936 A 6/1949 Boye
2,644,258 A * 7/1953 Gillette ..... E05D 15/04 49/247
3,116,946 A * 1/1964 Deloume ..... E05C 17/443 292/77
3,307,295 A * 3/1967 Rolin ..... E04F 21/0007 49/396
3,453,777 A * 7/1969 Reilly ..... E04B 1/98 49/141
3,579,934 A * 5/1971 Pietsch ..... E05C 19/16 49/394
4,320,598 A * 3/1982 Rodak ..... E06B 7/18 49/480.1
4,590,709 A * 5/1986 Katsman ..... H02B 1/38 312/276

(Continued)

FOREIGN PATENT DOCUMENTS

GB 164429 A * 6/1921 ..... E05F 7/005
KR 101179144 B1 * 9/2012

*Primary Examiner* — Jerry E Redman
(74) *Attorney, Agent, or Firm* — Parsons & Goltry, PLLC; Michael W. Goltry; Robert A. Parsons

(57) ABSTRACT

Improvements to a door frame and a door having an outer edge and an inner edge mounted for movement between an open position of the door withdrawn from the door frame and a closed position of the door received by the door frame, the improvements including bearing components carried by the door frame and the door proximate to the outer edge. One of the bearing components includes a member, and the other one of the bearing components includes a roller. The roller is brought into rolling contact directly against the member as the door is closed and remains in rolling contact directly against the member when the door is closed, positively lifting and supporting the door thereby preventing the door from sagging or binding on the door frame as the door is almost closed and when the door is in the closed position.

2 Claims, 13 Drawing Sheets

(56) References Cited

U.S. PATENT DOCUMENTS

| | | | | |
|---|---|---|---|---|
| 5,074,611 | A * | 12/1991 | Newkirk | B60J 5/0431 16/382 |
| 7,930,801 | B2 * | 4/2011 | Hilger | E05F 7/06 16/32 |
| 8,615,928 | B2 * | 12/2013 | Wang | E04H 17/00 49/226 |
| 2011/0047881 | A1 * | 3/2011 | Bjorn | E05B 3/00 49/399 |
| 2019/0254429 | A1 * | 8/2019 | Barker | E05D 7/081 |

* cited by examiner

Fig. 4
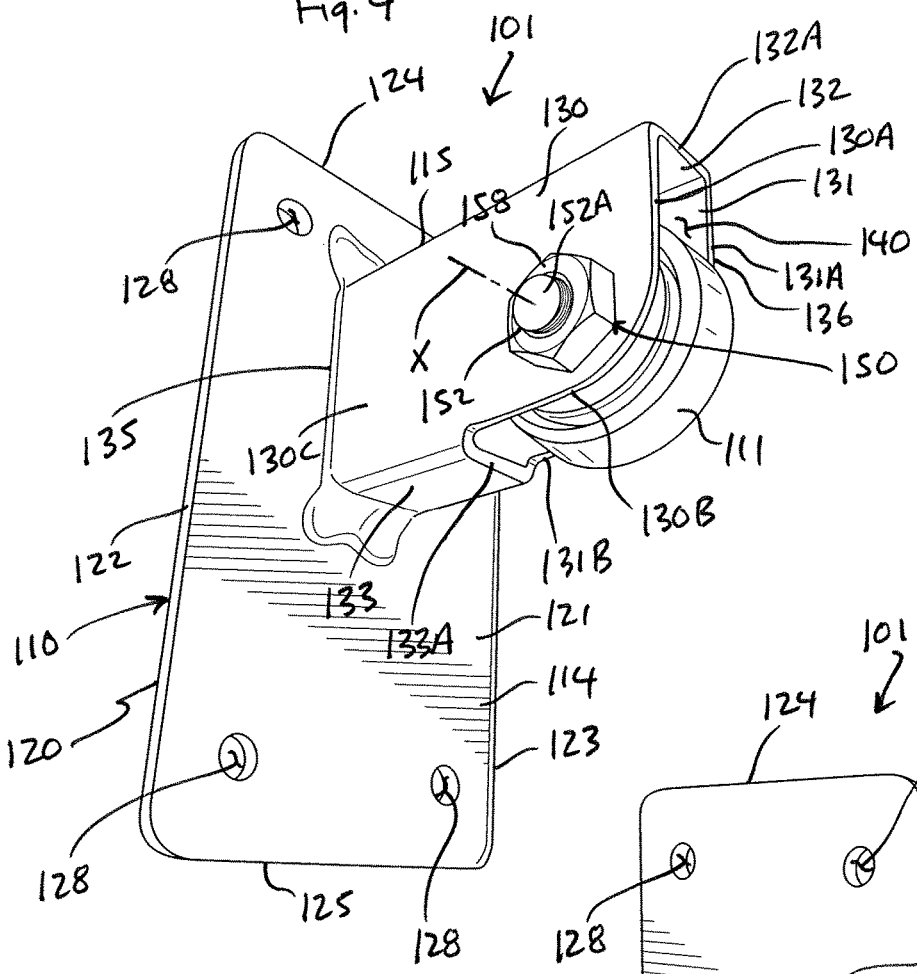
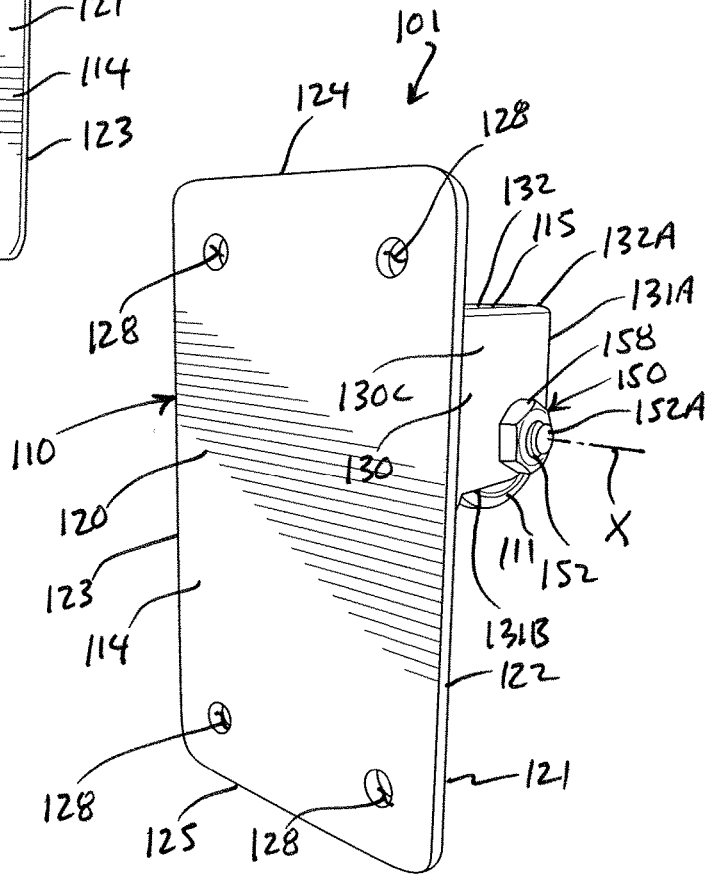
Fig. 5

SUPPORT ATTACHMENTS FOR A DOOR AND A DOOR FRAME

FIELD OF THE INVENTION

The present invention relates generally to doors and door frames and, more particularly, to support attachments for arresting a door from sagging or binding on a door sill or frame when the door is in a closed position.

BACKGROUND OF THE INVENTION

A common door assembly includes a door having an outer edge and an inner edge mounted for movement between an open position of the door withdrawn from the door frame and a closed position of the door received by the door frame. It is well known that doors of this type in use will sag and bind in the door frame, particularly heavy doors, such as those used with wide door frames common to garages. To alleviate this problem, skilled artisans have developed a variety of attachments for doors designed to support the door from sagging when the door is in the closed position. Some attachments include two fixed members, one on the door frame and the other on the door. The two fixed members are brought together as the door is closed for lifting and supporting the outer edge of the door. The two fixed members slide across one another when they are brought together, in which the inherent friction between the two, fixed member resulting from them sliding across one another inherently makes opening and closing the door difficult. Other attachments include braces and levers connected between the door and the door frame or the wall adjacent the door. These braces and levers are complex in structure and expensive, unsightly, and difficult to install, often requiring the help of a skilled workman. Given these and other deficiencies, the person having ordinary skill in the art of anti-sag attachments for doors will readily appreciate the need for continued improvement in the field.

SUMMARY OF THE INVENTION

According to the principle of the invention, disclosed herein are improvements to a door frame and a door having an outer edge and an inner edge mounted for movement between an open position of the door withdrawn from the door frame and a closed position of the door received by the door frame. In an exemplary embodiment, the improvements include bearing components carried by the door frame and the door proximate to the outer edge, respectively, one of the bearing components includes a member, and the other one of the bearing components includes a roller, and the roller is brought into rolling contact directly against the member as the door is closed and remains in rolling contact directly against the member when the door is closed, positively lifting and supporting the outer edge of the door thereby preventing the door from sagging or binding on the door frame as the door is almost closed and when the door is in the closed position. In another exemplary embodiment, the improvements include bearing components carried by the door frame and the door proximate to the outer edge, respectively, one of the bearing components includes a member mounted to a base, the other one of the bearing components includes a roller mounted to a fixture, and the roller is brought into rolling contact directly against the member as the door is closed and remains in rolling contact directly against the member when the door is closed, positively lifting and supporting the door thereby preventing the door from sagging or binding on the door frame as the door is almost closed and when the door is in the closed position without interference from the base and the fixture and without the base and the fixture making direct contact against the member.

BRIEF DESCRIPTION OF THE DRAWINGS

Referring to the drawings:

FIG. 4 is a bottom right front perspective view of the embodiment of FIG. 2;

FIG. 5 is a right rear perspective view of the embodiment of FIG. 2;

DETAILED DESCRIPTION

Disclosed herein are improvements, inexpensive and easily-installed improvements, to a door frame and a door having an outer edge and an inner edge mounted for movement between an open position of the door withdrawn from the door frame and a closed position of the door received by the door frame, the improvements for positively lifting and supporting the door thereby preventing the door from sagging or binding on the door frame as the door is almost closed and when the door is in the closed position.

I. The Door and Door Frame

Figure 1:
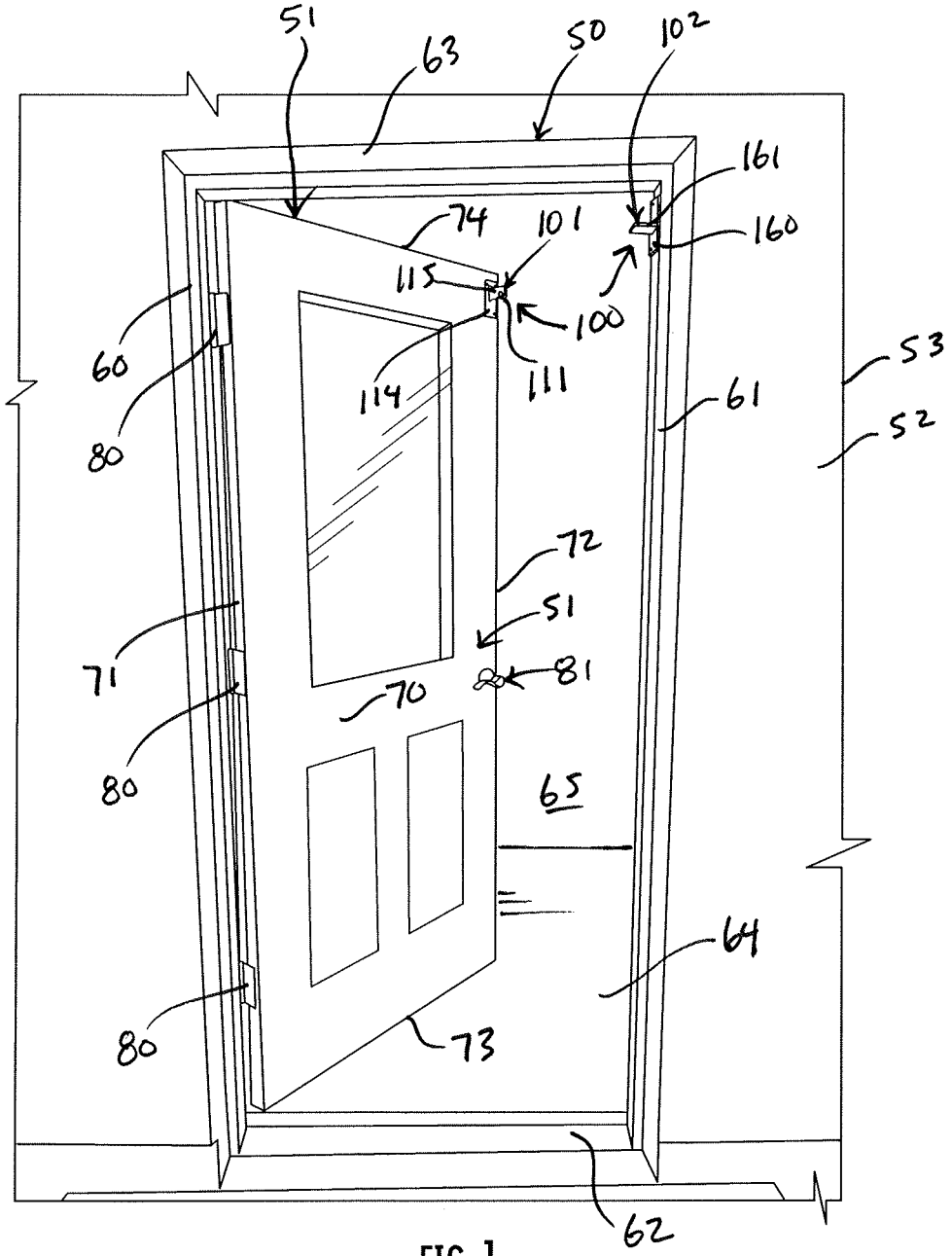
FIG. 1 is a perspective view of a door assembly including a door frame and a door mounted to the door frame, and additionally support attachments for positively lifting and supporting the door thereby preventing the door from sagging or binding on the door frame as the door is almost closed and when the door is in the closed position, the support attachments including a first attachment in the nature of a bearing component carried by the door and a second attachment in the nature of a bearing component carried by the door frame.
Figure 19:
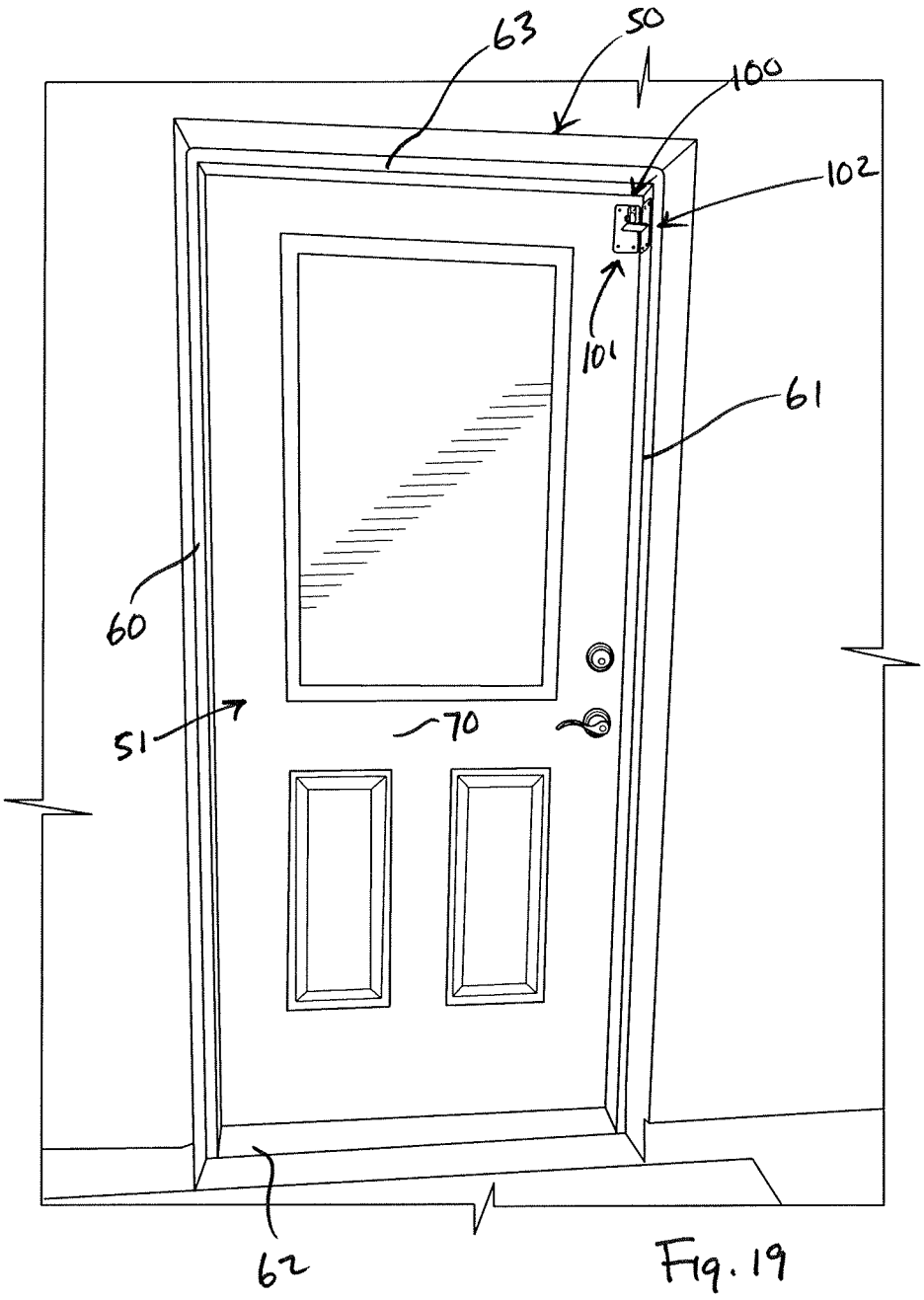
FIG. 19 is a view corresponding to FIGS. 17 and 18 illustrating the door as it would appear in the closed position and the support attachments positively lifting and supporting the door thereby preventing the door from sagging or binding on the door frame.

Turning now to the drawings, in which like reference characters indicate corresponding elements throughout the several views, attention is first directed to FIG. 1 illustrating door frame 50 and door 51 mounted for movement between an open position of door 51 withdrawn from door frame 50 and a closed position of door 51 received by door frame 50 in FIG. 19. Door frame 50 is of standard construction, is formed in standard wall 52 of a standard building 53, such as a garage, shed, or house, and includes opposed parallel jambs 60 and 61 that extend vertically upright from the respective inner and outer sides of horizontal sill 62 proximate to floor 64 to the respective inner and outer sides of horizontal header 63. Sill 62, the lower horizontal member of door frame 50, often referred as a threshold or saddle, is parallel to header 63, the upper horizontal member of door frame 50. Jambs 60 and 61, sill 62, and header 63 define opening 65, which can be referred to as a door frame opening or entranceway, sized to receive door 51 when door 51 is in its closed position in FIG. 19.

Like door frame 50, door 51 is a standard movable, usually solid, barrier for opening and closing opening 65, turning on hinges 80 in this example in the opening and closing of door 51. Door 51 is of standard construction and includes opposed parallel major faces, the one face 70 shown in FIG. 1 being the outward-facing or door frame-facing face, opposed parallel inner and outer edges 71 and 72, and opposed parallel lower and upper edges 73 and 74. Inner and outer edges 71 and 72 extend upright from the respective inner and outer sides of bottom edge 72 to the respective inner and outer sides of top edge 73. Standard hinges 80, three in this example, connect/mounted inner edge 71 of door 51 to jamb 60 hingedly for hinged movement of door 51 between its open position in FIG. 1 withdrawn from door frame 50 to open opening 65 thereby enabling passage through opening 65 and its closed position in FIG. 19 received by door frame 50 to close opening 65 thereby disabling passage through opening 65. Inner edge 71 of door 51 and jamb 60 of door frame 50 are juxtaposed and concurrently extend upright from the respective inner sides of sill 62 and lower edge 73 of door 51 to the respective inner sides of header 62 and upper edge 74 of door 51, outer edge 72 of door 51 and jamb 61 of door frame 50 are juxtaposed and concurrently extend upright from the respective outer sides of sill 62 and lower edge 73 of door 51 to the respective outer sides of header 62 and upper edge 74 of door 51, lower edge 73 of door 51 and sill 62 are juxtaposed and concurrently extend horizontally from the respective lower sides of jamb 60 and inner edge 71 of door 51 to the respective lower sides of jamb 61 and outer edge 72 of door 51, and upper edge 73 of door 51 and header 63 are juxtaposed and concurrently extend horizontally from the respective upper sides of jamb 60 and inner edge 71 of door 51 to the respective upper sides of jamb 61 and outer edge 72 of door 51, when door 51 is in its closed position in FIG. 19 received by door frame 50. Door 51 and jamb 61 of door frame 50 are formed with a standard lock-set package 81 for securing door 51 in its closed position in FIG. 19 and releasing door 51 from its closed position to enable door 51 to be hingedly opened and closed as needed.

Door frame 50 and door 51 described briefly above form a standard and well-known door assembly. Accordingly, further details of door frame 50 and door 51 forming the door assembly shown and described in conjunction with FIGS. 1 and 19 will readily occur to the person having ordinary skill in the art and are thereby not discussed in further detail except to the extent necessary to provide a complete and enabling disclosure of the invention described throughout the balance of this specification.

II. The Support Attachments

The door assembly shown and described herein in conjunction with FIGS. 1 and 19 additionally includes an improvement of support attachments, denoted generally at 100, for positively lifting and supporting door 51 thereby preventing door 51 from sagging or binding on door frame 50 as door 51 is almost/partially closed and when door 51 is in its closed position in FIG. 19. Support attachments 100 include a first attachment in the nature of a bearing attachment/component 101 and a second attachment in the nature of a bearing attachment/component 102. In this example, bearing component 101 is attached to and is thus carried by door 51, and bearing component 102 is attached to and is thus carried by door frame 50. Bearing component 101 and bearing component 102 are automatically brought together in direct rolling contact without interference from anything else as door 51 is closed automatically and positively lifting and supporting outer edge 72 of door 51 thereby preventing door 51 from sagging or binding on door frame 50 as door 51 is almost/partially, meaning very nearly or all but, closed and when door 51 is in the closed position and until door 51 is moved back to its open position from beyond its almost closed position. Since the direct contact between bearing component 101 and bearing component 102 is a rolling contact, the rolling contact is inherently a low friction/drag contact compared to the comparatively higher shearing friction/drag that automatically occurs between components that slide against one another.

Bearing components 101 and 102 are mounted at an elevated location above sill 62 and floor 64. This disables bearing components 101 and 102 from being kicked by foot and damaged as a result of the ordinary use of door 51. Neither of bearing components 101 or 102 consists of sill 62 or floor 64. In operation during the opening and closing of door 51, neither of bearing components 101 or 102 touches or otherwise interacts with sill 62 or floor 64 or anything else except each other according to this disclosure.

A. The Bearing Component of the Support Attachments

Referring in relevant part to FIGS. 2-7, bearing component 101 includes fixture 110, and roller 111 mounted rotatably to fixture 110. Fixture 110 is fashioned of steel, aluminum, or other chosen metal having inherently rigid, rugged, strong, and resilient material characteristics, and includes vertical base 114 that carries attached comparatively horizontal beam 115.

Base 114 is a flat base plate including opposed parallel and coextensive inner and outer surfaces 120 and 121, and a perimeter edge defined by four edges including opposed parallel side edges 122 and 123 that extend between opposed parallel upper and lower edges 124 and 125. In this example, base 114 is generally rectangular in overall shape, in which side edges 122 and 123 are equal in length and somewhat longer than upper and lower edges 124 and 125, which are equal in length. Base 114 is formed with fastener openings 128, which extend through base 114 from inner surface 120 to outer surface 121, for receiving fasteners for securing base 114 to a chosen surface. In this example, base 114 is formed with four fastener openings 128, two of which are near upper edge 124 proximate to the respective side edges 122 and 123, and the other two of which are near lower edge 125 proximate to the respective side edges 122 and 123.

Base 114 carries beam 115. Beam 115 is connected rigidly to base 114 and is a structural element that is capable of withstanding load primarily by resisting bending. Beam 115 is hollow and includes vertical walls 130 and 131, horizontal top wall 132 that defines an upper end of beam 115, and horizontal bottom wall 133 that defines a lower end of beam 115. For reference purposes and ease of discussion, reference character 132 is used interchangeably for denoting the upper end of beam 115 and top wall of beam 115, and reference character 133 is used interchangeably for denoting both the lower end of beam 115 and the bottom wall of beam 115.

Walls 130 and 131 are coextensive, parallel and spaced apart and extend vertically upright between and from either side of the respective horizontal top and bottom walls 132 and 133 that are spaced apart and parallel relative to one another. Walls 130-133 cooperate to define a hollow interior of beam 115 and opening 140 to the hollow interior of beam 115. Walls 130 and 131 and top wall 132 are equal in length. Bottom wall 133 is shorter in length compared to walls 130 and 131 and top wall 132, being approximate half as long as each of walls 130-132 in this illustrative embodiment. Walls 130 and 131 and top and bottom walls 132 and 133 that define the upper and lower ends of beam 115 define proximal end 135 of beam 115, and walls 130-132 define the opposite distal extremity 136 of beam 115.

Proximal extremity 135 of beam 115 is affixed rigidly, via welding in this example, centrally to outer surface 121 of base 114. Beam 115 extends horizontally outward from proximal extremity 135 affixed rigidly to outer surface 121 of base 114 to distal extremity 136. Walls 130 and 131 and top and bottom walls 132 and 133 that define the upper and lower ends of beam 115, extend horizontally outward from proximal end 135 of beam 115 affixed rigidly and centrally to outer surface 121 of base 114 to outer end 133A of bottom wall 133, and walls 130 and 131 and top wall 132 further extend horizontally outward from outer end 133A of bottom wall 132 to an outer end 132A of top wall 132 and outer ends 130A and 131A of the respective walls 130 and 131, which cooperate to define distal extremity 136 of beam 115. Beam 115 extends vertically upright in direction from lower edge 125 of base 114 to upper edge 124 of base 114 from bottom wall 133, the lower end of beam 115, to top wall 132, the upper end of beam 115. Beam 115 is perpendicular relative to inner surface 120 and outer surface 121 of base 114.

Outer end 132A of top wall 132, outer ends 130A and 131A of walls 130 and 131, and lower ends 130B and 131B of wall 130 extending outward from either side of outer end 133A of bottom wall 133 to outer ends 130A and 131A of walls 130 and 131 cooperate to form opening 140 to within beam 115. Roller 111 is partially received in opening 140, and is mounted for rotation to distal end 136 of beam 115 for free and un restricted rotation about axis of rotation X.

Figure 2:
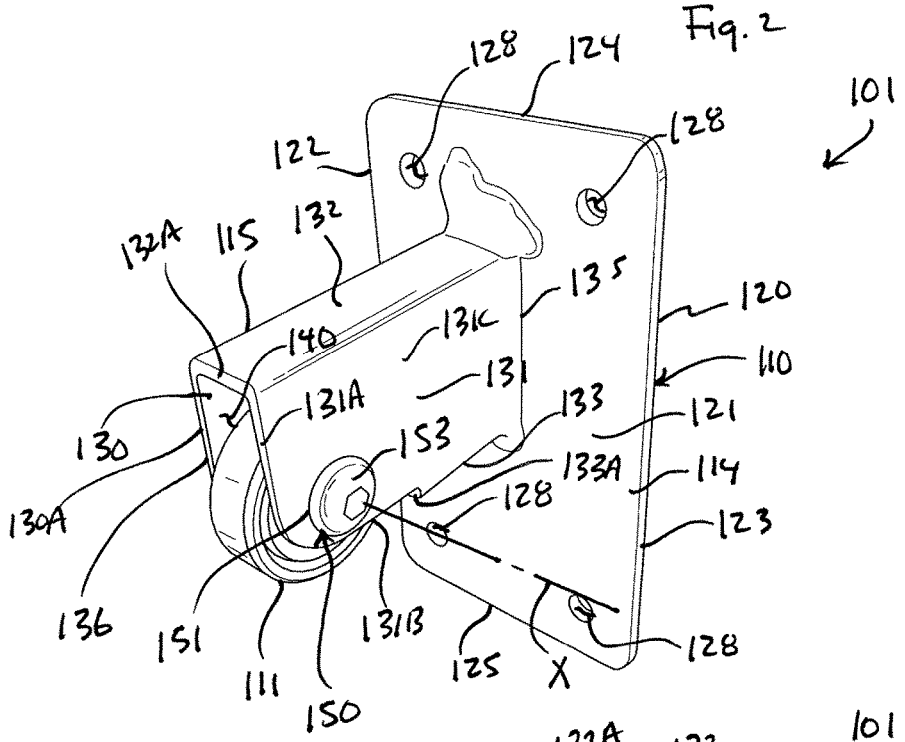
FIG. 2 is a top left front perspective view of the bearing component of FIG. 1.
Figure 3:
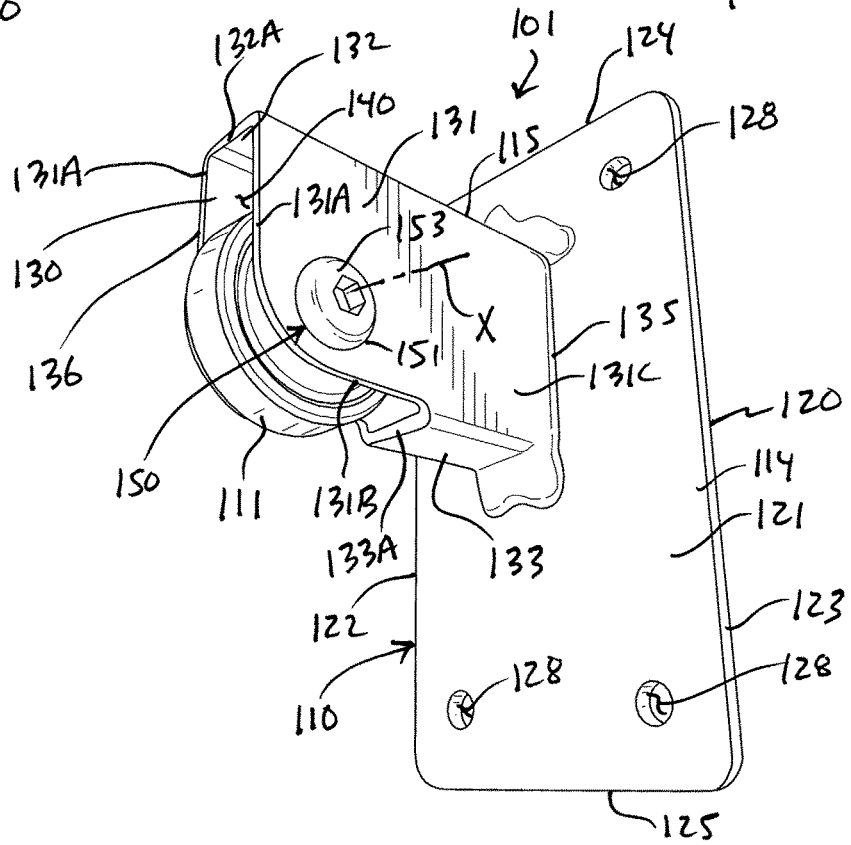
FIG. 3 is a bottom left front perspective view of the embodiment of FIG. 2.
Figure 6:
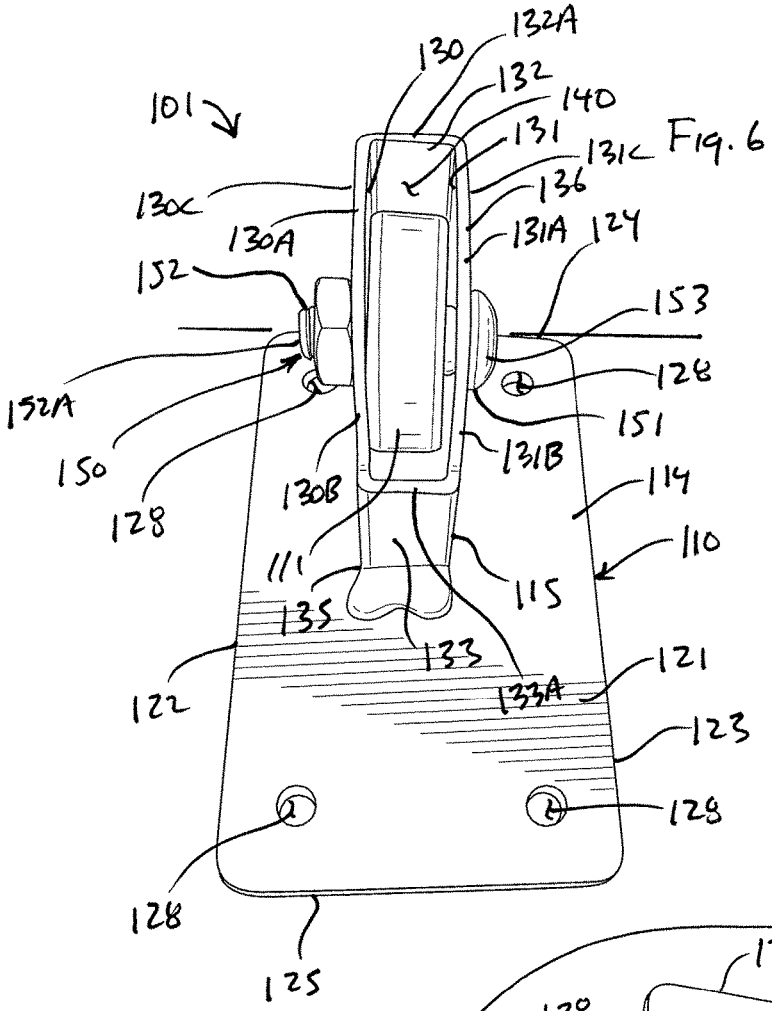
FIG. 6 is a bottom front perspective view of the embodiment of FIG. 2.
Figure 7:
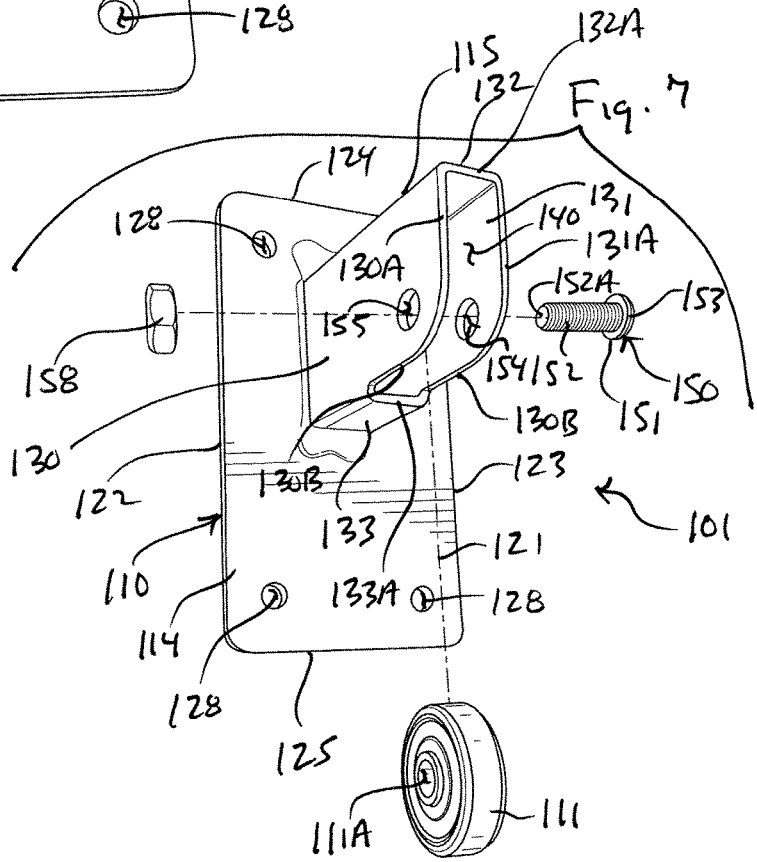
FIG. 7 is an exploded perspective view of the embodiment of FIG. 2.

In FIG. 7, roller 111 is mounted for rotation to distal end 136 of beam 115 with fastener 150. In this example, fastener 150 includes a standard bolt 151 and a corresponding standard nut 158. Bolt 151 includes threaded shank 152 that extends outward from head 153 to free end 152A. Shank 152 concurrently extends through opposed axially-aligned openings 154 formed through the respective walls 130 and 131 proximate to distal end 136 of beam 115 from head 153 received against outer surface 131C of wall 131 to free end 152A extending outward from outer surface 130C of wall 130, and through central opening 111A of roller 111 partially received in opening 140 between walls 130 and 131 under top wall 132. Nut 158 is threaded onto free end 152A of shank 152 and is tightened via rotation thereby tightening head 153 and nut 158 against the respective outer surfaces 131C and 130C of walls 131 and 130 thereby fixing roller 111 in place partially received in opening 140. The inherent diameter of opening 111A of roller 111 through which shank 152 extends is sufficiently larger than the inherent diameter of shank 152 to enable roller 111 to rotate freely about and respect to shank 152, without interference from beam 115 or any other part of fixture 110, in opening 140 about shank 152 about axis of rotation X referenced in FIGS. 2-6, which is perpendicular relative to walls 130 and 131 and parallel relative to outer surface 121 of base 114. Roller 111, a standard caster wheel of rugged and load-bearing construction, being of metal, plastic, ceramic, or other material or combination of materials having inherently rugged and load-bearing material characteristics, concurrently extends outward through opening beyond outer ends 130A and 131A of the respective walls 130 and 131, lower ends 130B and 131B of wall 130 extending outward from either side of outer end 133A of bottom wall 133 to outer ends 130A and 131A of walls 130 and 131, and bottom wall 133, as shown in FIGS. 2-4.

Roller 111 is removable from beam 115, such as for repair or replacement with a new roller, simply by detaching nut 158 from free end 152A of shank 152 and withdrawing bolt 151 from opening 155 of wall 130, opening 111A of roller 111, and opening 154 of wall 131, thereby freeing roller 111 from distal extremity 136. In alternate embodiments, roller 111 can be mounted for rotation to distal end 136 of beam 115 with a pin, rivet, or the like.

B. The Other Bearing Component of the Support Attachments

Figure 8:
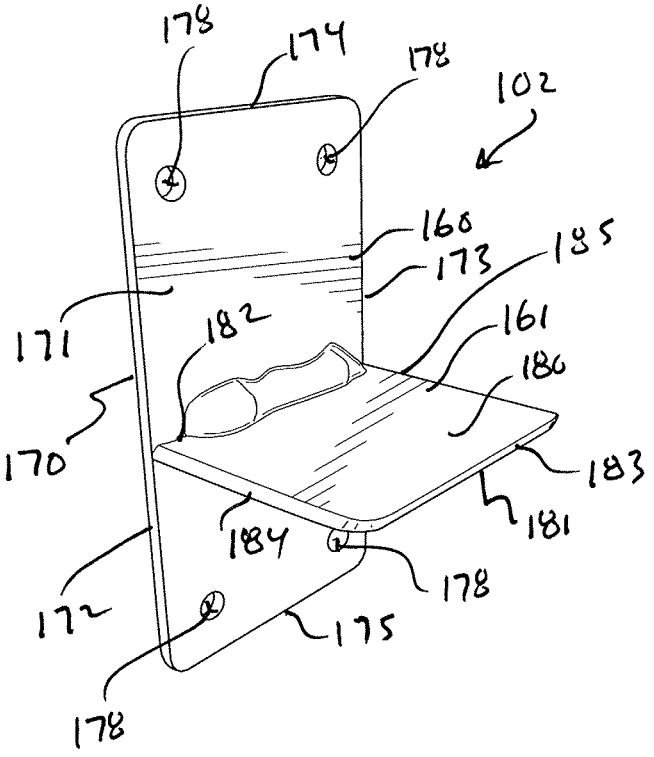
FIG. 8 is a top right front perspective view of the bearing component of FIG. 1.
Figure 9:
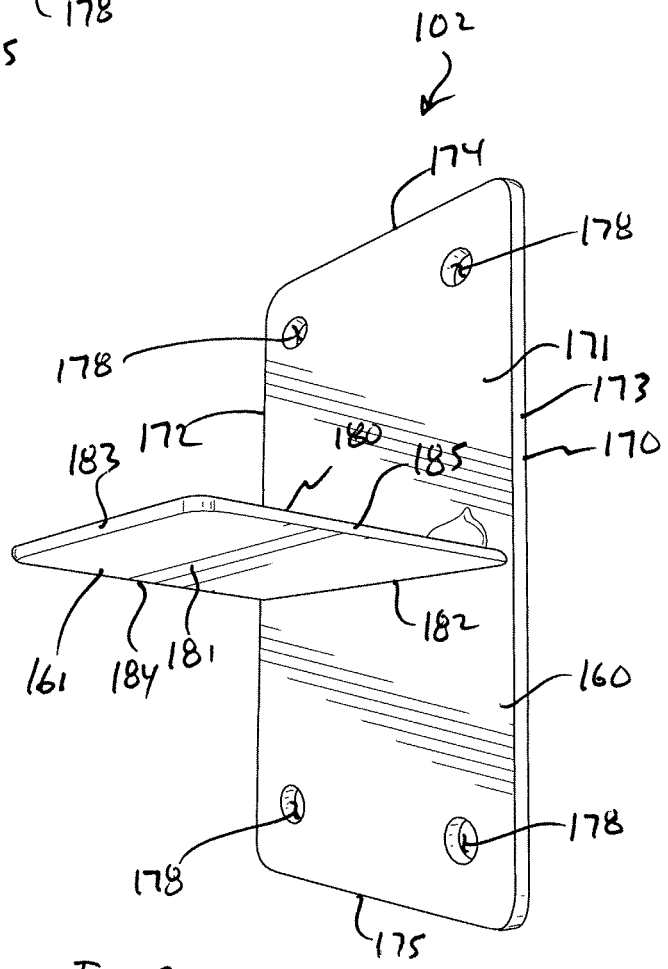
FIG. 9 is a bottom left front perspective view of the embodiment of FIG. 8.
Figure 10:
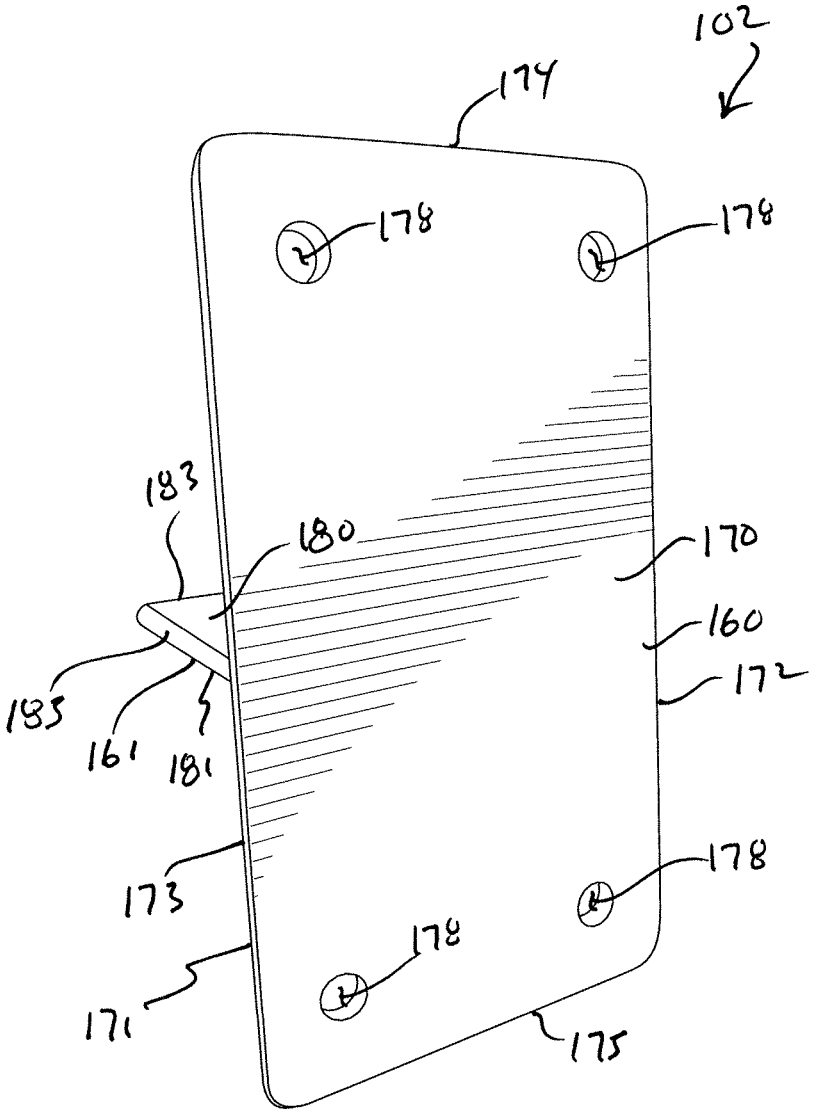
FIG. 10 is a left rear perspective view of the embodiment of FIG. 8.

Referring now in relevant part to FIGS. 8-10, bearing component 102 is fashioned of steel, aluminum, or other chosen metal having inherently rigid, rugged, strong, and resilient material characteristics, and includes vertical base 160 that carries attached comparatively horizontal member 161.

Base 160 is a flat base plate including opposed parallel and coextensive inner and outer surfaces 170 and 171, and a perimeter edge defined by four edges including opposed parallel side edges 172 and 173 that extend between opposed parallel upper and lower edge 174 and 175. In this example, base 160 is generally rectangular in overall shape, in which side edges 172 and 173 are equal in length and somewhat longer than upper and lower edges 174 and 175, which are equal in length. Base 160 is formed with fastener openings 178, which extend through base 160 from inner surface 170 to outer surface 171, for receiving fasteners for securing base 160 to a chosen surface. In this example, base 160 is formed with four fastener openings 178, two of which are near upper edge 174 proximate to the respective side edges 172 and 173, and the other two of which are near lower edge 175 proximate to the respective side edges 172 and 173.

Base 160 carries member 161. Member 161 is connected rigidly to base 160 and is a structural element that is capable of withstanding load primarily by resisting bending. Member 161 is a flat horizontal plate, including opposed parallel and coextensive surfaces 180 and 181, and a perimeter edge defined by four edges including opposed parallel inner and outer edges 182 and 183 that extend between opposed parallel side edges 184 and 185. In this example, member 161 is generally rectangular in overall shape, in which inner and outer edges 182 and 183 and side edges 184 and 185 are substantially equal in length. Surface 180 is a bearing surface, and is the upper surface of member 161. Surface 181 is the lower surface of member 161. Accordingly surface 180 may be referred as both an upper surface of member 161 and a bearing surface of member 161, and surface 181 may be referred to as a lower surface.

Inner edge 182 of member 161 is rigidly affixed via welding centrally to outer surface 171 of base 160 between upper edge 174 of base 160 and lower edge 175 of base 160. Inner edge 182 is parallel relative to upper and lower edges 174 and 175 of base 160, is perpendicular relative to side edges 172 and 173, and extends across outer surface 171 from side edge 184 of member 161 proximate side edge 172 of base 160 to side edge 185 of member 161 proximate to side edge 173 of base 160. Member 161 is perpendicular relative to inner and outer surfaces 170 and 171 of base 160, and projects horizontally outward from inner edge 182 to outer edge 183. Upper and lower surfaces 180 and 181 are horizontal, are parallel relative to each other, and are perpendicular relative to inner and outer surfaces 170 and 171 of base 160. Bearing surface 180 faces upwardly in the direction of upper edge 170 of bae 160, and lower surface 181 faces downwardly in the opposite direction of lower edge 171 of base 160.

III. The Support Attachments and the Door Assembly

Figure 16:
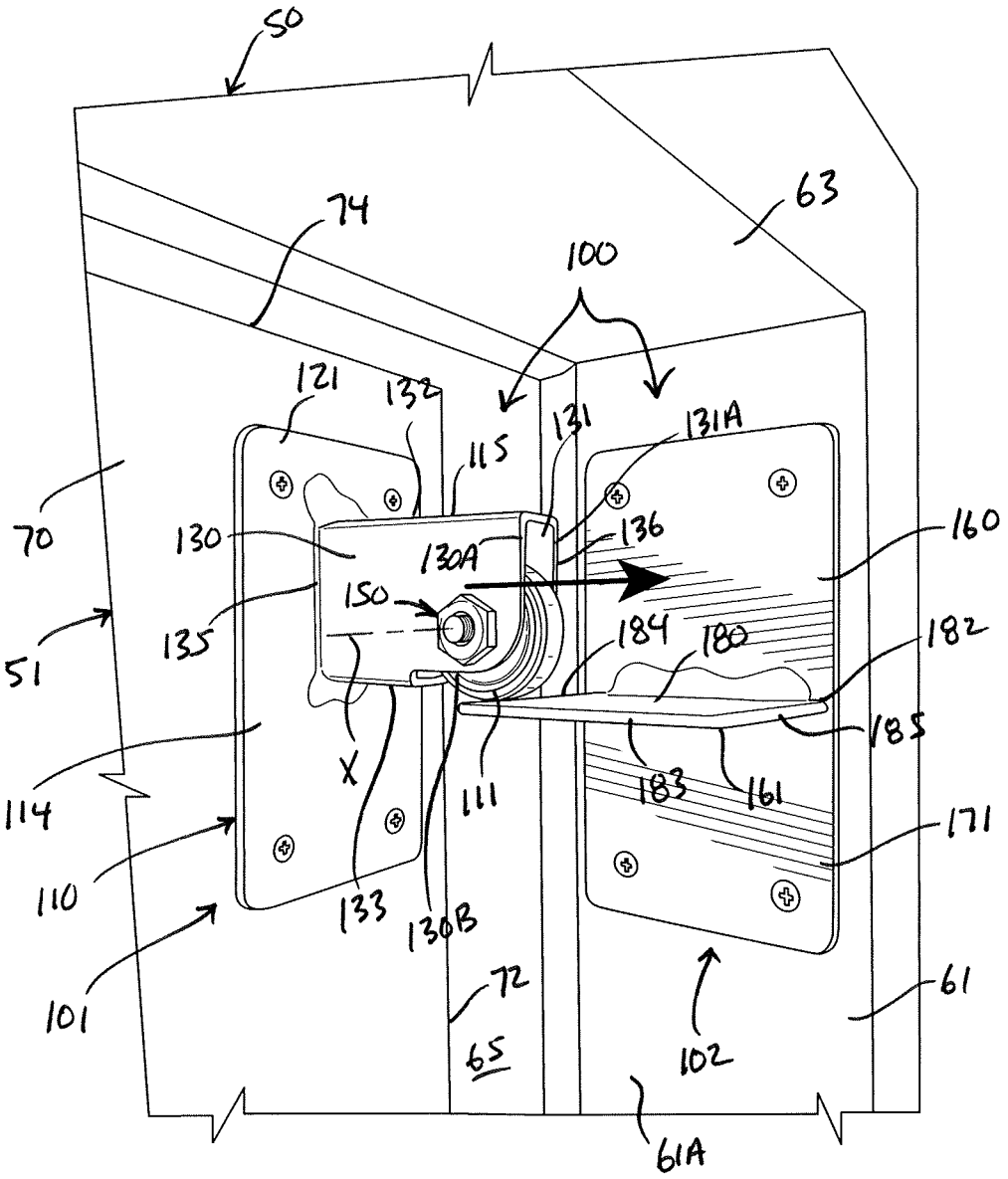
FIG. 16 is a view corresponding to FIG. 1 illustrating a roller of the bearing component brought into rolling contact directly against a member of the bearing component positively lifting and supporting the door thereby preventing the door from sagging or binding on the door frame as the door is almost closed.
Figure 17:
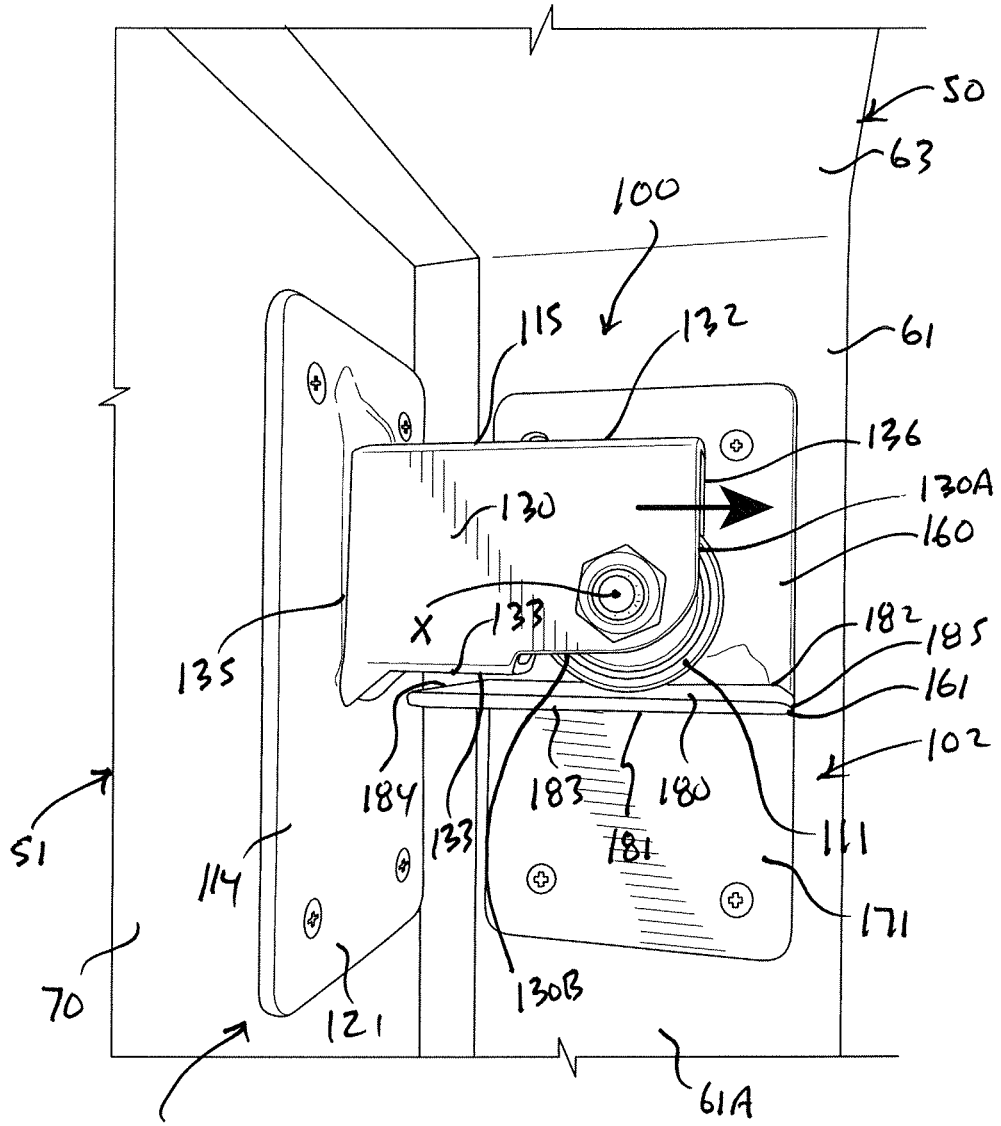
FIGS. 17 and 18 are side and front views corresponding to FIG. 16 illustrating the roller in rolling contact directly against the member preventing the door from sagging or binding on the door frame when the door is in the closed position.
Figure 18:
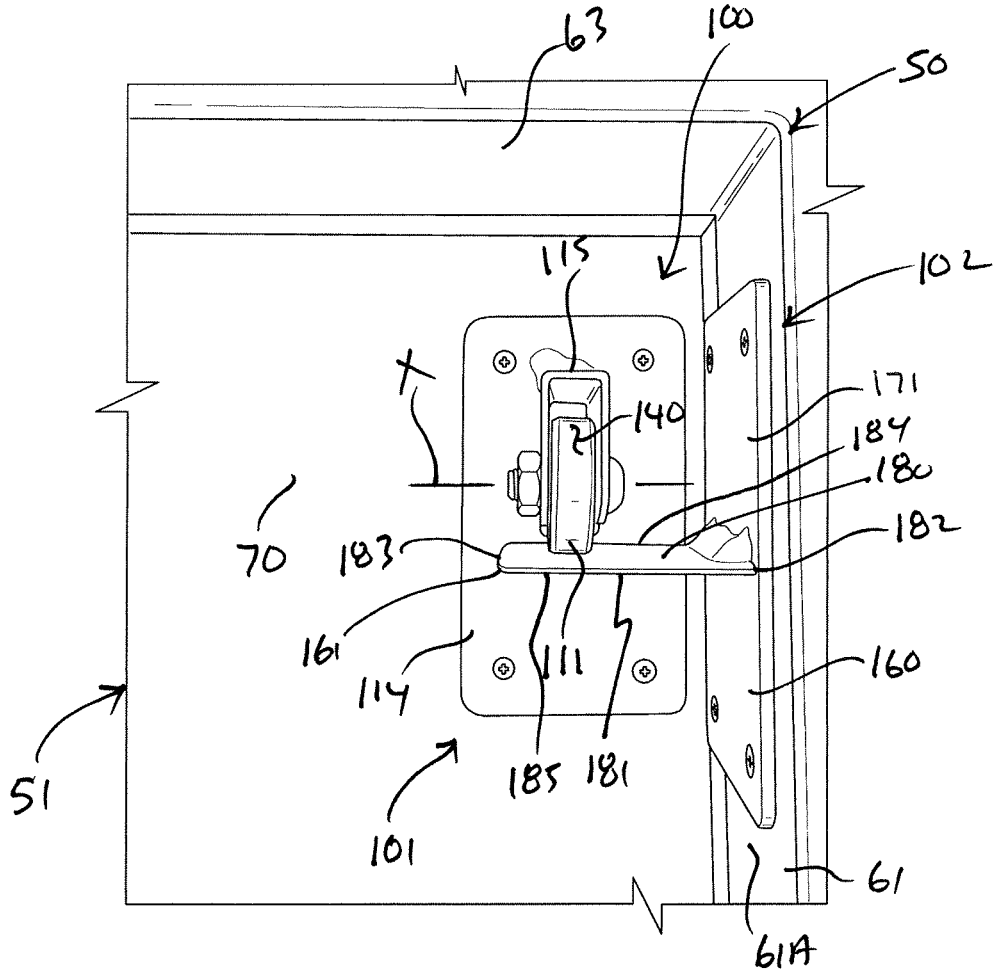

The door assembly shown and described herein in conjunction with FIGS. 1 and 19 incorporates the improvement of support attachments 100 for positively lifting and supporting door 51 thereby preventing door 51 from sagging or binding on door frame 50 as door 51 is almost closed in FIG. 16 and when door 51 is in its closed position in FIGS. 17-19. Bearing component 101 of support attachments 100 is attached to and thus carried by door 51 at an elevated location relative to sill 62 and floor 64 near outer edge 72 proximate to upper 74 thereby disabling bearing component 101 from directly contacting or otherwise interacting with sill 62 and floor 64. Bearing component 102 is attached to and thus carried by jamb 61 of door frame 50 at an elevated location relative to sill 62 and floor 64 proximate to header 63 thereby disabling bearing component 102 from directly contacting or otherwise interacting with sill 62 and floor 64. Roller 111 of bearing component 101 and bearing surface 180 of member 161 are brought together automatically in direct rolling contact as door 51 is closed automatically and positively lifting and supporting outer edge 72 of door 51 thereby preventing door 51 from sagging or binding on door frame 50 as door 51 is almost, meaning very nearly or all but, closed in FIG. 16 and when door 51 is in the closed position in FIGS. 17-19 and until door 51 is moved back to its open position from beyond its almost closed position. Since the direct contact between bearing component 101 and bearing component 102 is a rolling contact of roller 111 against bearing surface 180 of member 161, the rolling contact of roller 111 directly against bearing surface 180 of member is inherently a low friction/drag contact compared to the comparatively higher shearing friction/drag that automatically occurs between components that slide against one another.

Figure 11:
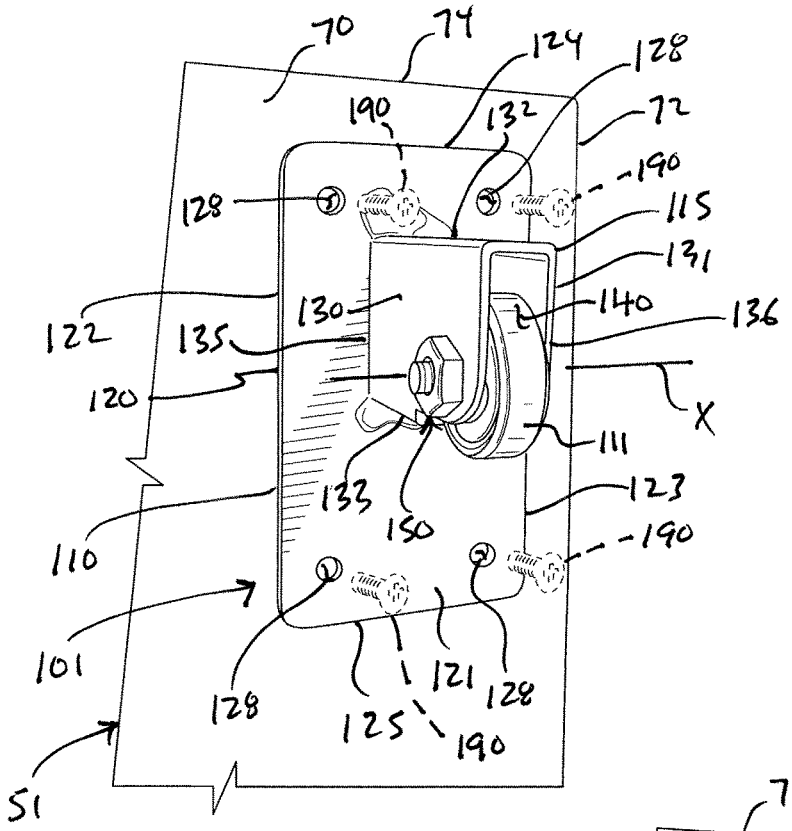
FIG. 11 is a perspective view of the bearing component of FIG. 1 shown positioned against the door and fasteners, depicted in phantom line, shown as they would appear before being attached for securing the bearing component to the door.
Figure 12:
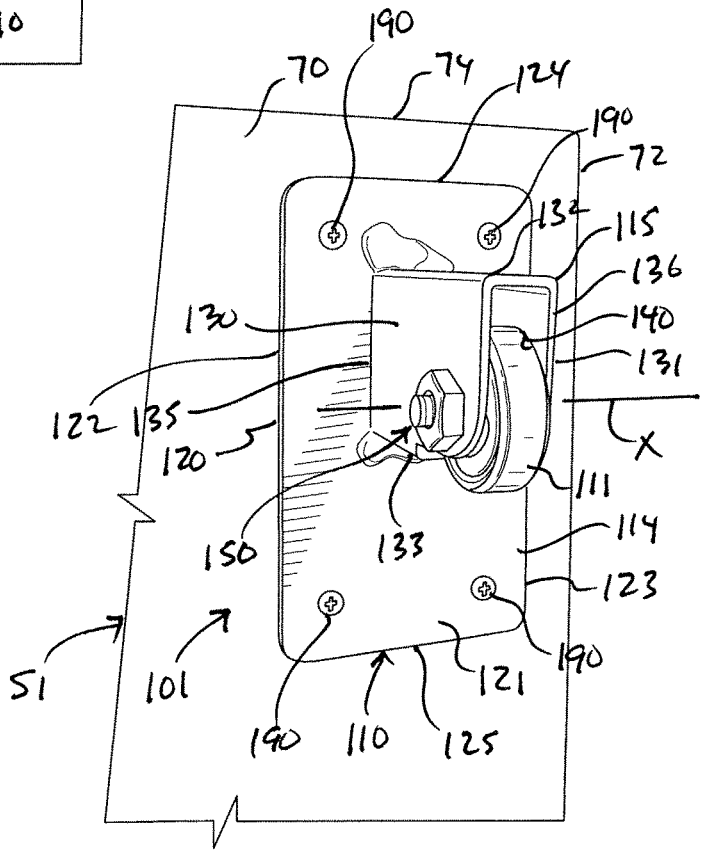
FIGS. 12 and 13 are perspective views corresponding to FIG. 11 illustrating the fasteners as they would appear attached securing the bearing component to the door.
Figure 13:
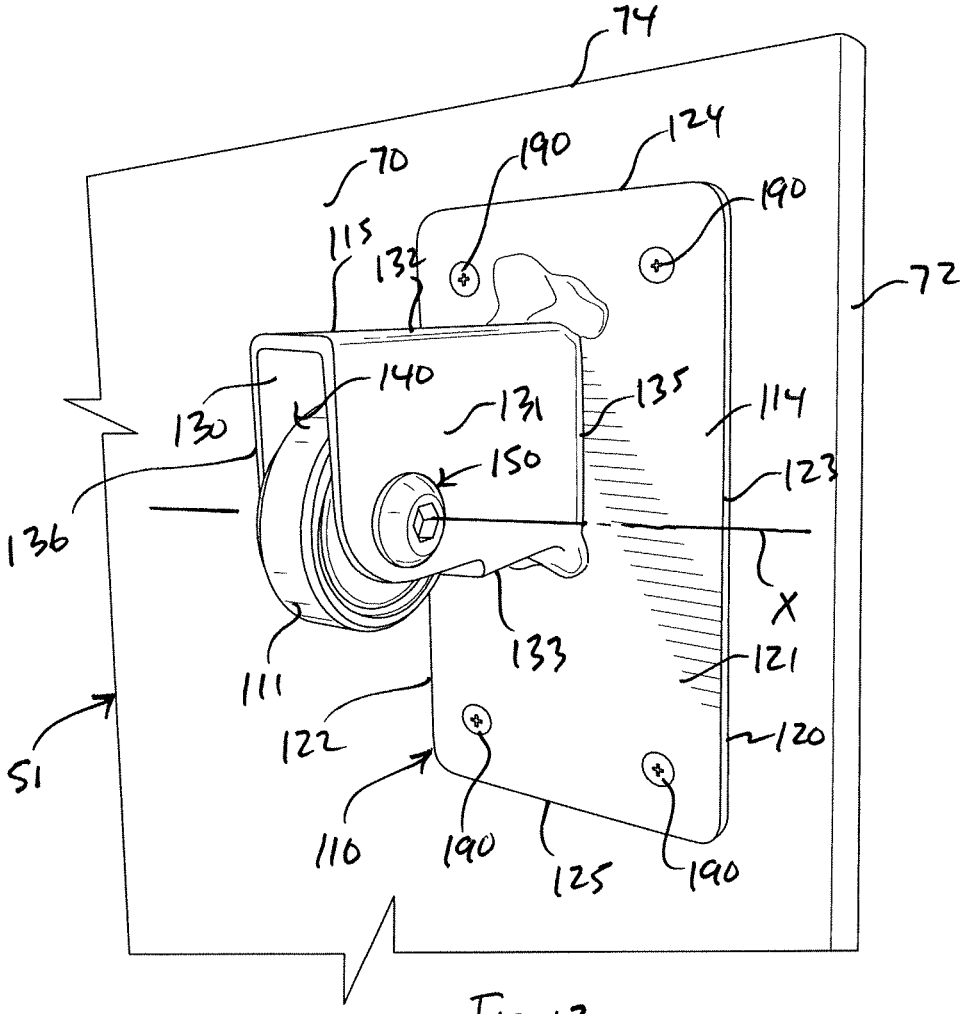

To attach bearing component 101 to door 51 in FIGS. 11-13, fixture 110 is positioned upright from lower 125 to upper edge 124, inner surface 120 of base 114 is brought flat into direct flush contact against face 70 of door 51 near outer edge 72 and proximate to upper 74 setting upper edge 124 of base 114 parallel to upper edge 174 of door 51, setting side edge 123 of base 114 parallel to outer edge 72 of door 51 thereby automatically orienting beam 115 to extend horizontally outward and away from face 70 of door 51 and outer surface 121 of base 114 from proximal end 135 to roller 111 at distal end 136 of beam 115 and upright from lower bottom wall 133, the lower end of beam 115, to top wall 132, the upper end of beam 115, and setting axis X of rotation of roller 111 parallel to upper edge 74 of door 51 and perpendicular relative to outer edge 72 of door 51. Then, base 114 is secured to door 51 by standard screws 190. Screws 190, depicted in phantom line in FIG. 11, are axially aligned with the respective fastener openings 128 through base 114 and passed, one after the other, through fastener openings 128 and threaded into door 51 through face 70 and tightened via rotation thereby securing bearing component 101 to face 70 of door 51 near outer edge 72 proximate to upper 74 in FIGS. 12 and 13. In this example, door 51 is fashioned of wood, composite material, or other standard material capable of enabling screws 190 to thread therein via rotation along with the application of a force sufficient to threadably sink screws 190 into the material of door 51 to provide a secure attachment of base 114 of bearing component 101 to face 70 of door 51.

Figure 14:
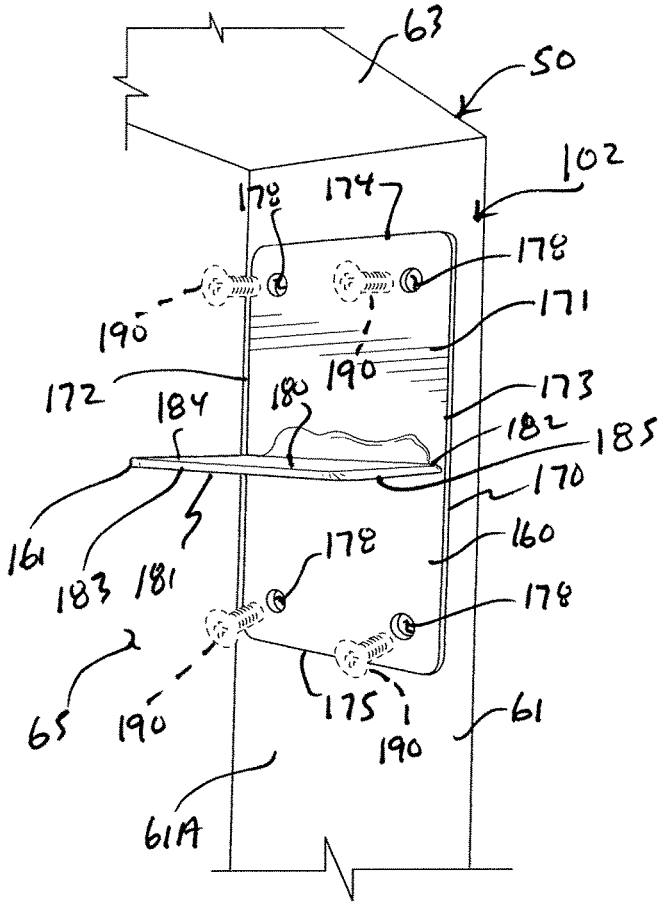
FIG. 14 is a perspective view of the bearing component of FIG. 1 shown positioned against the door frame and fasteners, depicted in phantom line, shown as they would appear before being attached for securing the bearing component to the door frame.
Figure 15:
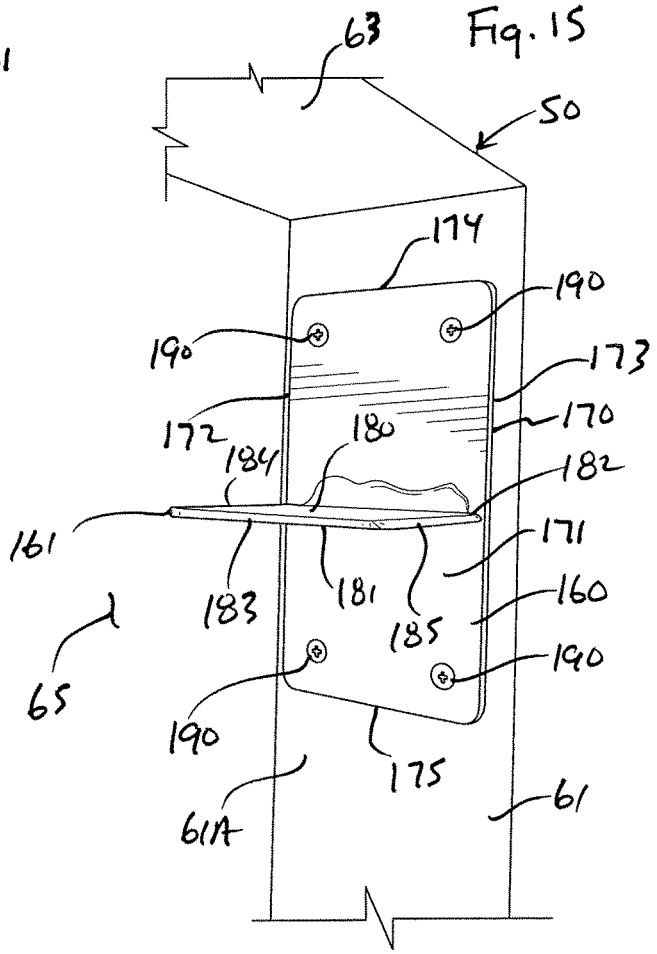
FIG. 15 is a perspective view corresponding to FIG. 14 illustrating the fasteners as they would appear attached securing the bearing component to the door frame.

To attach bearing component 102 to jamb 61 of door frame 50 in FIGS. 14 and 15, bearing component 102 is positioned upright from lower 175 of base 160 to upper edge 174 of base 160, inner surface 170 is brought flat into direct flush contact against the exterior surface 61A of jamb 61 facing opening 65 proximate to header 63 setting upper edge 174 of base 160 parallel header 63 thereby orienting member 161 to extend horizontally outward and away from exterior surface 61A of jamb 61 and outer surface 171 of base 160 into opening 65 from inner edge 182 to outer edge 183 and upper and lower surfaces 180 and 181 horizontally, bearing surface 180 facing upwardly toward header 63 and lower surface 181 facing downwardly toward sill 62. Then, base 160 is secured to jamb 61 by standard screws 190. Screws 190, depicted in phantom line in FIG. 11, are axially aligned with the respective fastener openings 178 through base 160 and passed, one after the other, through fastener openings 178 and threaded into jamb 61 through exterior surface 61A of jamb 61 and tightened via rotation thereby securing bearing component 102 to exterior surface 61A of jamb 61 near header 63 in FIG. 15. In this example, jamb 61 is fashioned of wood, composite material, or other standard material capable of enabling screws 190 to thread therein via rotation along with the application of a force sufficient to threadably sink screws 190 into the material of jamb 61 to provide a secure attachment of base 160 of bearing component 102 to exterior surface 61A of jamb 61.

In the installation of bearing component 101 to door 51 near outer edge 72 proximate to upper 74 and bearing component 102 to exterior surface 61A of jamb 61 proximate to header 63, roller 111 of bearing component 101 and bearing surface 180 of member 161 of bearing component 102 are aligned/registered enabling them to co-act in rolling contact in FIGS. 16-18 to lift and positively support door 51 thereby preventing door 51 from sagging or binding on door frame 50 as door 51 is almost closed in FIG. 16 and when door 51 is fully closed in its closed position in FIGS. 17-19 and until door 51 is moved back to its open position from beyond its almost closed position in FIG. 16. In FIG. 16, door 51 is almost closed, meaning very nearly or all but closed, in which roller 111 is brought into direct contact against and atop bearing surface 180 of member 161 between outer surface 171 of base 160 and outer edge 183 of member 161. In the position of door 51 being almost closed in FIG. 16 and by forcing door 51 to its closed position in FIGS. 17-19, roller 111 remains in direct contact against bearing surface 180 between outer surface 171 of base 160 and outer edge 183 of member 161 and rolls directly against and over and is supported by bearing surface 180 of member 161 between outer surface 171 of base 160 and outer edge 183 of member 161 until roller 111 reaches an intermediate position of bearing surface 180 between side edges 184 and 185 and between outer surface 171 of base 160 and outer edge 183 of member 161 when door 51 reaches its closed position in FIGS. 17 and 18, in which co-acting roller 111 and bearing surface 180 of member 161 lift/raise door 51 toward header 63 and positively support door 51 from sagging, downwardly in the opposite direction of sill 62, enabling door 51 to be received by door frame 50 without binding against door frame 50, according to the invention.

The co-acting relationship between roller 111 and bearing surface 180 is characterized by roller 111 rolling along and directly against underlying bearing surface 180 by revolving or turning over and over about axis X of rotation directly against and over bearing surface 180 from door 51 being almost closed in FIG. 16 to door 51 being fully closed in its closed position in FIGS. 17 and 18, and roller 111 remaining in stationary rollable/rolling contact directly against bearing surface 180 when door 51 is in its closed position from being moved into its closed position from its position of being almost closed in FIG. 16 and until door 51 is moved back to its open position from beyond its almost closed position, all for positively lifting and supporting door 51 from sagging enabling door 51 to be received by door frame 50 without binding against door frame 50 and, importantly, without interference from base 160 and fixture 110 and without base 160 and fixture 110 or anything else making direct contact against member 161 against bearing surface 180 of member 161 against which roller 111 is brought into rolling contact, which avoids any part of fixture 110 or base 160 or anything else from sliding across bearing surface 180 of member 161 or any part of bearing component 102 or anything else that would inherently cause a sliding friction that would inherently make closing door 51 into its closed position from its open position inherently and comparatively more difficult. How roller 111 concurrently extends outward through opening beyond outer ends 130A and 131A of the respective walls 130 and 131, lower ends 130B and 131B of wall 130 extending outward from either side of outer end 133A of bottom wall 133 to outer ends 130A and 131A of walls 130 and 131, and bottom wall 133, as shown in FIGS. 2-4, disables any part of fixture 110 from making direct contact against bearing surface 180 of member 161 or any part of bearing component 102 or anything else other that the direct rolling contact of roller 111 directly against bearing surface 180 of member 161.

The co-acting relationship between roller 111 and bearing surface 180 is further characterized by roller 111 rolling directly against and over bearing surface 180 from door 51 being in its closed position in FIGS. 17-19 to door 51 being almost closed in FIG. 16, for positively lifting and supporting door 51 from sagging enabling door 51 to be withdrawn from door frame 50 without binding against door frame 50 and without any other part of fixture 110 making direct contact against bearing surface 180 of member 161, which avoids any part of fixture 110 from sliding across bearing surface 180 of member 161 or anything else that would inherently cause a sliding friction that would inherently make opening door 51 from its closed position inherently and comparatively more difficult.

In the illustrative disclosed herein, bearing component 101, the component of support attachments 100 that moves concurrently with the moving of door 51, is attached to and carried by door 51, and bearing component 102, the component of support attachments 100 that is stationary, is attached to and carried by door frame 50. This can be reversed in an alternate embodiment, in which bearing component 101 can be attached to and carried by door frame 50, and bearing component 102 can be carried by door 51. In the latter example, bearing component 101 carried by door 51 is inverted 180 degrees, and lower surface 181 of member 161 of bearing component 102, in this embodiment now being the component of support attachments 100 that moves concurrently with the moving of door 51, would be received over and by underlying roller 111 of bearing component 101, in this embodiment now being the component of support attachments 100 that is stationary, in which stationary roller 111 would co-act with the moving/movable lower surface 181 as described above and the resulting function is the same.

Those having regard for the art will readily appreciate that disclosed herein are improvements to door frame 51 and door 51 having outer edge 72 and inner edge 71 mounted for movement between an open position of door 51 withdrawn from door frame 50 and a closed position of door 51 received by door frame 50. In a particular embodiment the improvements include bearing components carried by or otherwise mounted to door frame 50 and door 51 proximate to outer edge 72, respectively. One of the bearing components includes member 161, and the other one of the bearing components includes roller 111. Roller 111 is brought into direct rolling contact directly against member 161 as door 51 is closed and remains in direct rolling/rollable contact directly against member 161 when door 51 is closed, positively lifting and supporting outer edge 72 of door 51 thereby preventing door 51 from sagging or binding on door frame 50 as door 51 is almost/partially closed and when door 51 is in the closed position. In another embodiment, the improvements include bearing components carried by or otherwise mounted to door frame 50 and door 51 proximate to outer edge 72, respectively. One of the bearing components includes member 161 mounted to base 160, and the other one of the bearing components includes roller 111 mounted to fixture 110. Roller 111 is brought into direct rolling contact directly against member 161 as door 51 is closed and remains in direct rolling/rollable contact directly against member 161 when door 51 is closed, positively lifting and supporting door 51 thereby preventing door 51 from sagging or binding on door frame 50 as door 51 is almost/partially closed and when door 51 is in the closed position without interference from base 160 and fixture 110 and without base 160 and fixture 110 making direct contact against member 161.

IV. CONCLUSION

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. In a door frame and a door mounted for movement between an open position of the door withdrawn from the door frame and a closed position of the door received by the door frame, the door including an outer edge and a major planar face, improvements therein comprising:

bearing components carried by the door frame and the door, respectively;

a first one of the bearing components comprises one of a member and a roller supported outwardly relative to the door frame, and a second one of the bearing components comprises another one of the member and the roller supported outwardly relative to the major planar face proximate to the outer edge; and the roller is brought into rolling contact directly against the member outwardly relative to both the door frame and the major planar face as the door is closed and remains in rolling contact directly against the member outwardly relative to both the door frame and the major planar face when the door is closed, positively lifting and supporting the outer edge of the door thereby preventing the door from sagging or binding on the door frame as the door is almost closed and when the door is in the closed position.

2. In a door frame and a door including a major planar face, an outer edge, and an inner edge mounted for movement between an open position of the door withdrawn from the door frame and a closed position of the door received by the door frame, improvements therein comprising:

a first base mounted to the door frame;

a second base mounted to the major planar face proximate to the outer edge;

bearing components carried by the first base and the second base, respectively, a first one of the bearing components comprises one of a member and a roller supported outwardly from the door frame by the first base, and a second one of the bearing components comprises another one of the member and the roller supported outwardly from the major planar face by the second base; and the roller is brought into rolling contact directly against the member outwardly relative to both the door frame and the major planar face as the door is closed and remains in rolling contact directly against the member outwardly relative to both the door frame and the major planar face when the door is closed, positively lifting and supporting the door thereby preventing the door from sagging or binding on the door frame as the door is almost closed and when the door is in the closed position without interference from the base and the fixture and without the base and the fixture making direct contact against the member.

* * * * *